US010526166B2

(12) United States Patent
Gerstenmeyer et al.

(10) Patent No.: US 10,526,166 B2
(45) Date of Patent: Jan. 7, 2020

(54) METHOD FOR OPERATING AN ELEVATOR WITH MULTIPLE SHAFTS AND CARS

(71) Applicants: THYSSENKRUPP ELEVATOR AG, Essen (DE); thyssenkrupp AG, Essen (DE)

(72) Inventors: Stefan Gerstenmeyer, Filderstadt (DE); Markus Jetter, Filderstadt (DE); Patrick Michael Bass, Naperville, IL (US)

(73) Assignees: THYSSENKRUPP ELEVATOR AG, Essen (DE); THYSSENKRUPP AG, Essen (DE)

( * ) Notice: Subject to any disclaimer, the term of this patent is extended or adjusted under 35 U.S.C. 154(b) by 262 days.

(21) Appl. No.: 15/552,891

(22) PCT Filed: Feb. 22, 2016

(86) PCT No.: PCT/EP2016/053659
§ 371 (c)(1),
(2) Date: Aug. 23, 2017

(87) PCT Pub. No.: WO2016/135090
PCT Pub. Date: Sep. 1, 2016

(65) Prior Publication Data

US 2018/0237257 A1 Aug. 23, 2018

(30) Foreign Application Priority Data

Feb. 23, 2015 (DE) ..... 10 2015 102 563

(51) Int. Cl.
*B66B 1/34* (2006.01)
*B66B 1/24* (2006.01)
(Continued)

(52) U.S. Cl.
CPC ..... *B66B 1/2466* (2013.01); *B66B 1/2491* (2013.01); *B66B 1/3407* (2013.01);
(Continued)

(58) Field of Classification Search
CPC ... B66B 1/2466; B66B 1/2491; B66B 1/3407; B66B 5/0087; B66B 9/003; B66B 2201/24; B66B 2201/302
(Continued)

(56) References Cited

U.S. PATENT DOCUMENTS 3,658,155 A 4/1972 Salter
5,861,586 A * 1/1999 McCarthy ..... B61B 15/00 187/289
(Continued)

FOREIGN PATENT DOCUMENTS

CN 101678993 A 3/2010
CN 101979301 A 2/2011
(Continued)

OTHER PUBLICATIONS

English translation of International Search Report issued in PCT/EP2016/053659 dated May 12, 2016 (dated May 24, 2016).
English abstract of EP1367018A.

*Primary Examiner* — Anthony J Salata
(74) *Attorney, Agent, or Firm* — thyssenkrupp North America, Inc.

(57) ABSTRACT

A method for operating an elevator system can be used with elevator systems that include at least two cars and at least two vertically extending elevator shafts where the at least two cars can be moved between the at least two elevator shafts. In a first operating mode transportation operations are performed by the at least two cars in the at least two elevator shafts. In a second operating mode a location of at least one of the at least two cars is restricted to at least one region of
(Continued)

at least one of the at least two elevator shafts. In the second operating mode, the at least one of the at least two cars is not available for transportation operations in remaining regions of the at least two elevator shafts.

8 Claims, 4 Drawing Sheets

(51) Int. Cl.
*B66B 5/00* (2006.01)
*B66B 9/00* (2006.01)

(52) U.S. Cl.
CPC ..... *B66B 5/0087* (2013.01); *B66B 9/003* (2013.01); *B66B 2201/24* (2013.01); *B66B 2201/302* (2013.01)

(58) Field of Classification Search
USPC ..... 187/247, 249, 380–388, 391, 393
See application file for complete search history.

(56) References Cited

U.S. PATENT DOCUMENTS 5,865,274 A * 2/1999 Kiji ..... B66B 1/2458 187/249
5,877,462 A * 3/1999 Chenais ..... B66B 5/0031 187/249
6,955,245 B2 * 10/2005 Dunser ..... B66B 1/2466 187/249
7,213,685 B2 * 5/2007 Hikita ..... B66B 1/20 187/249
7,537,089 B2 5/2009 Duenser
7,621,376 B2 * 11/2009 Duenser ..... B66B 9/00 187/247
7,650,966 B2 * 1/2010 Sansevero ..... B66B 1/2466 187/249
7,841,450 B2 * 11/2010 Smith ..... B66B 1/18 187/249
8,297,409 B2 * 10/2012 Hsu ..... B66B 1/2433 187/247
8,602,168 B2 * 12/2013 Tschuppert ..... B66B 9/00 187/249
8,905,196 B2 * 12/2014 Suzuki ..... B66B 1/2458 187/382
2003/0217893 A1 11/2003 Dunser
2014/0190774 A1 7/2014 Hsu
2018/0201472 A1 * 7/2018 Gerstenmeyer ..... B66B 1/2466
2018/0334360 A1 * 11/2018 Steinhauer ..... B66B 5/0087

FOREIGN PATENT DOCUMENTS

CN 203048360 U 7/2013
CN 103303769 A 9/2013
EP 1367018 A 12/2003
EP 1619157 A 1/2006
EP 2070860 A 6/2009
JP H 05 39173 A 2/1993
JP H0539173 A 2/1993
JP H05124781 A 5/1993
JP 7 112875 5/1995
JP H07277615 A 10/1995
KR 2003-0091801 A 12/2003
KR 10-2014-0021674 A 2/2014

* cited by examiner

METHOD FOR OPERATING AN ELEVATOR WITH MULTIPLE SHAFTS AND CARS

CROSS REFERENCE TO RELATED APPLICATIONS

This application is a U.S. National Stage Entry of International Patent Application Serial Number PCT/EP2016/053659, filed Feb. 22, 2016, which claims priority to German Patent Application No. DE 10 2015 102 563.9 filed Feb. 23, 2015, the entire contents of both of which are incorporated herein by reference.

FIELD

The present disclosure generally relates to lift systems and, more particularly, to methods of operating lift systems with a plurality of shafts and cars.

BACKGROUND

In elevator systems with a plurality of elevator shafts cars can often switch between these elevator shafts and move in a plurality of elevator shafts. A high transportation capacity (handling capacity HC) can thus be achieved, and a multiplicity of transportation operations can be carried out in particular simultaneously by the elevator system. Elevator systems of this type are referred to as for example shaft-switching multiple-car systems.

However, elevator systems of this type have the disadvantage that empty cars which are currently not being utilized for a transportation operation can obstruct other cars in elevator shafts. These empty cars thus, where appropriate, have to be moved first in order for other cars to be able to carry out a respective transportation operation. However, moving empty cars and not utilizing them for transportation operations is associated with unnecessary energy costs.

A possibility for depositing empty cars in a depository shaft in an elevator system is described in EP 1 367 018 B1. In the case of a request call, cars which have been deposited in the depository shaft can be provided again. This depository shaft is disposed between two elevator shafts having access openings. The depository shaft does not have any access openings.

A depository shaft of this type is associated with a large space requirement. Furthermore, in most instances, depository shafts of this type cannot be retrofitted in buildings.

EP 1 619 157 A1 discloses a method for operating an elevator system similar to the elevator system as per EP 1 367 018 B1. A special case during the operations process is described herein, in which a car by virtue of a defect unintentionally blocks the elevator shaft. The intact cars are now diverted by way of other elevator shafts.

An elevator system in which the shaft doors are set back from the travel path by at least one car width such that cars can pass another car in front of a door is shown in U.S. Pat. No. 3,658,155. Therefore, transportation operations of other cars do not have to be interrupted when a car stops. However, any storage of cars is not possible since the shaft door would be blocked in this case.

Such elevator systems also have the disadvantage that through continuous operation many empty runs likewise become necessary for specific situations in which transportation operations are to be carried out often between only a few floors.

Thus a need exists for improved elevator systems and improved operation of elevator systems having a plurality of elevator shafts and a plurality of cars which can switch between the elevator shafts to be further improved.

DETAILED DESCRIPTION

Figure 1B:
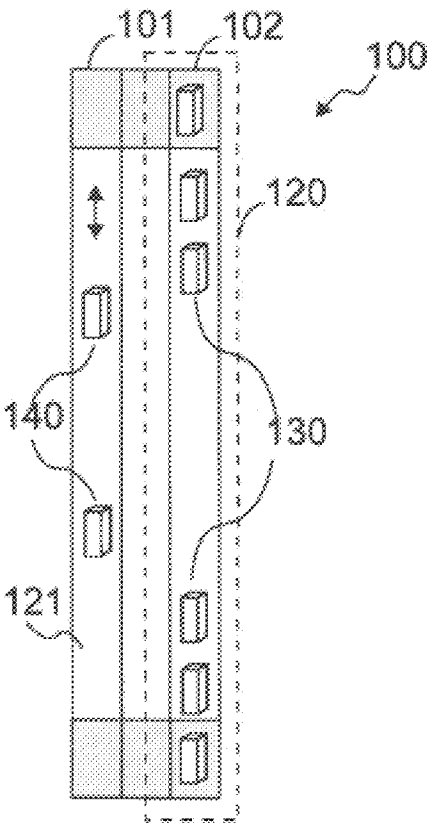
FIG. 1*b* is a schematic view of the example elevator system of FIG. 1*a* operating in a second operating mode.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The present disclosure generally relates to methods for operating elevator systems and to respective elevator systems with at least two cars and at least two vertically extending elevator shafts. In some examples, the at least two cars switch between the at least two elevator shafts.

The elevator system comprises at least two cars and at least two vertically extending elevator shafts. The at least two cars can be displaced between the at least two elevator shafts. Accordingly, the at least two cars are not fixedly assigned to any one elevator shaft but are purposively moved between the at least two elevator shafts according to demand. For this purpose, suitable connection paths, for example in the form of horizontal elevator shafts, are provided between the individual elevator shafts. Connection paths of this type can be provided only at specific locations or on specific floors of a building comprising the elevator system, for example. However, the connection paths can also be provided on each floor. Only specific elevator shafts can be interconnected in each case such that respective cars can only be switched between these connected elevator shafts. However, all elevator shafts can also be interconnected such that all cars can switch between all elevator shafts.

The elevator system can be operated in two operating modes. In a first operating mode transportation operations are carried out by the at least two cars in the at least two elevator shafts. This first operating mode is a regular operating mode of the elevator system.

In a second operating mode a potential location of at least one of the at least two cars is restricted to at least one region of at least one of the at least two elevator shafts. This restriction is in particular targeted, so is thus initiated by a control command and is not merely an inevitable unintentional result of a defect. This at least one of the at least two cars is not available for transportation operations in the remaining regions of the at least two elevator shafts. In particular, the at least one car is stored and optionally serviced there. The at least one of the at least two cars during the second operating mode does not leave this at least one second region and remains only within this region.

In particular, trans-regional transportation operations between the first regions and the at least one second region are carried out during the first operating mode. Furthermore, the elevator shafts in the first regions as well as in the second regions are in particular provided with shaft doors in order to enable passengers to enter the cars in the first operating mode. In particular, in the second operating mode such shaft doors that fundamentally enable access to the at least one second region are not available for passengers entering the cars. This means that the second region is substantially a conventional elevator shaft and facilitates transportation operations for passengers. The passengers can enter or leave the cars by way of shaft doors in this second region.

In one embodiment, this second region in the second operating mode can however "mutate" so as to become a depository shaft which is available only for storage purposes. The available elevator shaft herein is thus utilized for storage purposes in order for cars that are not required in the case of low utilization to be deposited. Since fewer cars are in operation in this case, the number of active elevator shafts (first regions) can also be reduced. As opposed to the prior art, depositing of cars is thus enabled without additional depository space being made available.

In particular, the at least one car that is not available for transportation operations in the remaining first regions is deactivated and is not used for the normal regular operation of the elevator system. In this case, this second region represents a storage region in which cars of the elevator system are stored.

In particular, a number of cars that are not available for transportation operations in the remaining first regions can be varied in the second operating mode. Depending on demand, different cars can be located in the at least one second region during the second operating mode. An individual car located in the at least one second region can be removed from the second region on demand and can again be utilized for transportation operations in the remaining first regions.

In particular, individual cars are stored in the at least one second region when all cars of the elevator system are not required for carrying out the transportation operations, for example in the case of comparatively light traffic and in the case of comparatively few transportation operations that are to be carried out.

It is enabled by way of the invention that a sufficiently large number of cars are provided in the elevator system in order for requirements to be met and that all transportation operations are able to be carried out efficiently at comparatively high or maximum traffic, respectively.

It is furthermore enabled by way of the invention that individual cars can be taken out of operation on demand. When not all cars of the elevator system are required, the former can be stored in a flexible manner in the at least one second region and do not need to be unnecessarily moved. Cars that are not required in conventional elevator systems have to be moved when empty so as to not obstruct or block, respectively, other cars that are required. This situation can be prevented on account of the invention. Energy costs for operating the elevator system can thus be reduced.

On account of the invention it is not necessary for additional special mounting points to be provided in the building that comprises the elevator system in order for cars to be stored, said mounting points being associated with an additional space requirement. Instead, the potential location of specific cars is restricted to expedient second regions, and the respective cars can be stored in this second region. Individual regions of the elevator system which are provided for the regular operation of the elevator system can thus be used on demand in particular for storing cars. The second regions in which cars are stored can likewise be used again for the regular operation on demand. Elevator systems in buildings can be retrofitted in a simple manner by software updates. No measures in terms of construction work to the building are required herein, and no additional storage points or shafts have to be installed in the building.

Advantageously, no transportation operations are carried out in the at least one second region, and the at least one of the at least two cars is not available for transportation operations. The at least one second region in the second operating mode in particular is thus used exclusively for storing or parking cars, respectively.

Alternatively in the second operating mode, transportation operations are advantageously carried out by the at least one of the at least two cars in the at least one second region. These transportation operations of the at least one of the at least two cars are carried out exclusively in the at least one second region and not in the remaining first regions of the elevator shafts. The at least one of the at least two cars in the course of these transportation operations does not leave the at least one second region and remains only within the second region. Local transportation operations can thus be carried out on demand in the second operating mode in the at least one second region. Cars of which the potential locations are in each case restricted to the at least one region and in particular are not required for the regular operation of the elevator system can nevertheless be used on demand for transportation operations within the at least one second region. Said cars are preferably moved in a bi-directional manner.

The at least one of the at least two cars is preferably serviced in the at least one second region. In particular, repairs can also be carried out on the respective cars in the at least one second region. Cars on which maintenance, service and/or repair works have to be carried out thus do not have to be taken out of operation explicitly for said works. The maintenance, service and/or repair works can be carried out in a flexible manner when the respective car is not already provided for the regular operation of the elevator system and is stored or parked, respectively, in the at least one second region.

Advantageously, switching between the first and the second operating mode takes place so as to depend on operating parameters of the elevator system. Switching between the operating modes can thus take place in a flexible manner during the normal operation of the elevator system without the elevator system having to be taken out of operation for this purpose.

In particular, in the first operating mode all cars of the elevator system are available for transportation operations in all elevator shafts and are also used for transportation operations. Thus, a maximum handling capacity (HC), that is to say a maximum transportation capacity, is enabled in particular in the first operating mode. The operating parameters provide information in particular pertaining to whether the maximum transportation capacity is required.

In particular, if it is identified by means of the operating parameters that the maximum transportation capacity is not required then switching to the second operating mode takes places. Herein, in particular only so many cars that are required are available for transportation operations. The remaining cars are stored in the at least one second region, in particular.

Preferably, a number of cars in the second operating mode that are not available for transportation operations in the remaining first regions is varied so as to depend on the operating parameters of the elevator system. It can be evaluated by means of the operating parameters in particular how many cars are required for carrying out all transportation operations in the remaining first regions. If not all available cars are required, individual cars can be expediently moved to the at least one second region and be stored in the latter, in particular. If the available cars are insufficient for carrying out all transportation operations, individual cars that are in the at least one second region can again be removed therefrom and utilized for transportation operations in the remaining first regions. It can thus be guaranteed that the required number of cars is at all times available for transportation operations in the remaining first regions. The required transportation capacity is provided at all times, and yet not so many cars are available, such that energy costs can be minimized as far as possible.

A number of regions and/or a size of the at least one second region in the second operating mode are/is preferably varied so as to depend on operating parameters of the elevator system. In particular, the same two second regions are not always used in the second operating mode, but the second regions can be expediently selected at all times. The size of individual second regions can be increased or decreased in a flexible manner, depending on how many cars are intended to be in said region. Furthermore, in the second operating mode further second regions of the elevator shafts can also be out of operation on demand and be used in particular for storing cars. Different second regions do not necessarily have to be mutually adjacent but can be distributed in an expedient manner. On the other hand, second regions can at all times also be "cancelled" on demand, and the cars therein can at all times be used again for transportation operations in the remaining first regions.

The above-mentioned parameters, depending in each case on whether switching between the operating modes takes places, the number of cars that are not available for transportation operations is varied, and the number and size of the second regions are varied, can in each case be the same operating parameters or else different operating parameters.

Advantageously, a required transportation capacity, a waiting time for passengers, a current utilization of the elevator system, a utilization profile, times of the day, and/or measured values of load and/or passenger identification sensors are used as operating parameters of the elevator system. A utilization of the elevator system indicates in particular how many transportation operations are being currently carried out, or are to be carried out by the elevator system. The utilization can also describe a number of passengers to be conveyed and/or loads to be transported, for example. The utilization can be determined by means of a call destination system, for example. The required transportation capacity can be determined from the current utilization and/or by means of the call destination system, for example.

The waiting time for passengers indicates in particular how long passengers have to wait in particular on average at their departure floor until a car for carrying out a respective transportation operation is provided. In order for this waiting time to be reduced, more cars in the remaining first regions (that is to say those utilized for transportation operations) of the elevator shafts are used in particular for transportation operations.

The number of passengers to be conveyed and/or of loads to be transported can in particular be specified as the measured value of suitable sensors, for example of load and/or passenger identification sensors. Load and/or passenger identification sensors of this type can be configured in particular as load or force measuring sensors, cameras, or infrared sensors. A sensor in a turnstile of the building that detects people passing the turnstile and entering the building can also be used as load and/or passenger identification sensors of this type.

Peak times during which it can be more favorable and more efficient for the elevator system to be operated in the first operating mode, for example, can arise at specific times of the day. The elevator system can thus be switched to the respective operating mode in a timely fashion. Peak times of this type are in particular an up peak, a down peak, or lunchtime traffic. During an up peak, a multiplicity of transportation operations are carried out by means of the cars of the elevator system to higher floors. During a down peak, a multiplicity of transportation operations are carried out by means of the cars of the elevator system to lower floors. During lunchtime traffic, a multiplicity of transportation operations are carried out by means of the cars of the elevator system in both directions, that is to say to lower floors as well as to higher floors. In the case of peak times of this type, a comparatively large number of transportation operations are to be carried out, to which end a maximum transportation capacity of the elevator system is required.

For example, if it is identified by means of the operating parameters that a specific time of day is about to start in which a peak time of this type arises, the elevator system is operated in the first operating mode, in particular. The elevator system is operated in the first operating mode in particular for an up peak, a down peak, or lunchtime traffic. The elevator system is operated in the second operating mode in particular outside these peak times.

A utilization profile indicates in particular a profile of transportation operations of the elevator system that are to be carried out. For example, the utilization profile can be determined so as to depend on the time of day, the day of the week, and/or the month. It can thus be learned at what times (both in terms of the times of the day, of the day of the week as well as of the month) peak times arise. A utilization profile can for example be a self-learning utilization profile. For example, a control unit of the elevator system can learn a utilization profile of this type over a predetermined time period. Utilization profiles can be determined in particular in an empirical, statistical, analytical, and/or numerical manner.

The at least one second region of the at least one of the at least two elevator shafts preferably extends across a plurality of in particular contiguous floors of a building comprising the elevator system. A part of the elevator shafts can thus be used in each case as a second region for storing cars.

The at least one second region of the at least one of the at least two elevator shafts advantageously extends across the entire vertical length of the at least one of the at least two elevator shafts. Entire elevator shafts of the elevator system can thus be taken out of operation and be used in particular for storing cars.

The at least two elevator cars in the at least two elevator shafts are preferably operated as one or a plurality of shaft-switching multiple-car systems. A number of in particular adjacent elevator shafts and a number of cars are in each case provided for one particular shaft-switching multiple-car system. In particular, the number of cars are only displaced within this number of elevator shafts, and the number of respective cars switch only between this number of elevator shafts. In particular, cars in a shaft-switching multiple-car system are displaced only upward in particular elevator shafts and only downward in other elevator shafts.

In one advantageous embodiment of the invention, in the first operating mode a first number of cars in a first number of elevator shafts are operated as a first shaft-switching multiple-car system, and a second number of cars in a second number of elevator shafts are operated as a second shaft-switching multiple-car system. In particular, the elevator shafts of the first and of the second number of elevator shafts are in each case adjacent. Furthermore particularly, all elevator shafts of the first and of the second number are interconnected. In particular, switching of all cars between all elevator shafts is possible.

In the second operating mode, the second shaft-switching multiple-car system is not operated in the second number of elevator shafts. Instead, the potential location of the at least one of the at least two cars which in the second operating mode is not available for transportation operations in the remaining first regions is restricted to the second number of elevator shafts. The first shaft-switching elevator system in particular also in the second operating mode is operated in the first number of elevator shafts. The second number of cars in the second operating mode can be used for transportation operations in other elevator shafts. Individual or all of the second number of cars can also be stored in the second number of elevator shafts.

Apart from the method for operating an elevator system, the invention furthermore relates to a respective elevator system. All of the features and advantages mentioned above are to apply in an analogous manner to the method according to the invention as well as to the elevator system according to the invention. The elevator system in particular comprises a suitable control unit which is adapted for carrying out a preferred embodiment of the method according to the invention.

The at least two elevator shafts of the elevator system each advantageously extend across a plurality of floors. Shaft doors to a plurality or all of the multiplicity of floors are provided in the elevator shafts.

Further advantages and design embodiments of the invention are derived from the description and from the appended drawing.

It is to be understood that the features mentioned above and those yet to be explained can be used not only in the combination that is stated in each case but also in other combinations or individually, without departing from the scope of the present invention.

The invention is schematically illustrated in the drawing by means of exemplary embodiments and will be described herein with reference to the drawing.

A preferred embodiment of an elevator system according to the invention is schematically illustrated in each of FIGS. 1 to 4, said embodiment in each case being adapted for carrying out a preferred embodiment of a method according to the invention. It is in each case schematically illustrated in FIGS. 1*a*, 2*a*, 3*a*, and 4*a* how the respective elevator system is operated in a first operating mode according to a preferred embodiment of a method according to the invention. It is in each case schematically illustrated in FIGS. 1*b*, 2*b*, 3*b* 3*c*, and 4*b* how the respective elevator system is operated in a second operating mode according to a preferred embodiment of a method according to the invention.

A preferred embodiment of an elevator system according to the invention is schematically illustrated and identified by 100 in FIG. 1. The elevator system 100 has two elevator shafts 101 and 102.

Figure 1A:
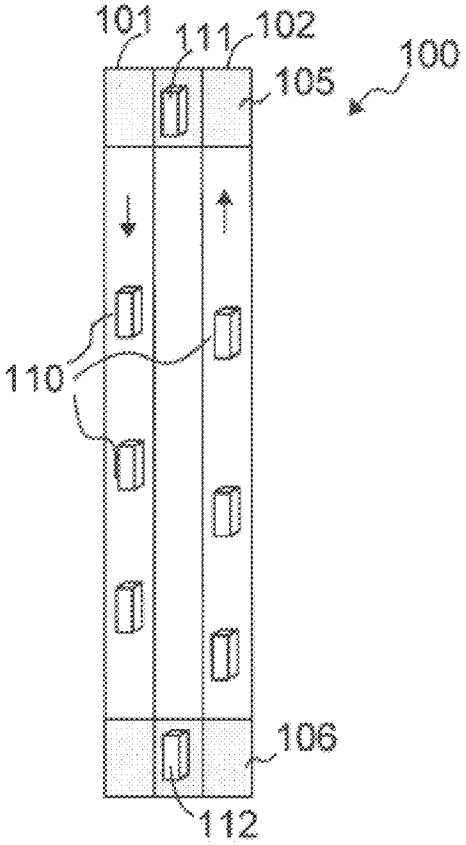
FIG. 1*a* is a schematic view of an example elevator system operating in a first operating mode.

The elevator system 100 is schematically shown in the first operating mode in FIG. 1*a*. A multiplicity of cars 110, in this example eight cars, are moved in the elevator shafts 101 and 102. Connections 105 and 106, respectively, between the elevator shafts 101 and 102 are provided on an uppermost floor and on a lowermost floor of a respective building comprising the elevator system 100. The cars can switch between the elevator shafts 101 and 102 by way of these connections 105 and 106.

In this example, cars in the elevator shafts 101 and 102 are in each case moved unidirectionally, that is to say in each case only in one direction. Cars are only displaced downward in the elevator shaft 101, and only upward in the elevator shaft 102. In the illustrated example, car 111 switches from the elevator shaft 102 to the elevator shaft 101 in the upper connection 105, and car 112 switches from the elevator shaft 101 to the elevator shaft 102 in the lower connection 106. The cars 110 in the elevator shafts 101 and 102 in the first operating mode are operated in particular as a shaft-switching multiple-car system.

The elevator system 100 is operated in the first or in the second operating mode so as to depend on operating parameters. For example, utilization profiles of the elevator system 100 are used as operating parameters of this type. These utilization profiles describe, for example, at what times of the day peak times arise. A multiplicity of transportation operations are to be carried out and a maximum transportation capacity of the elevator system 100 is to be provided in the course of these peak times. The elevator system 100 is operated in the first operating mode according to FIG. 1*a* at these peak times.

Outside these peak times, the elevator system 100 is operated in the second operating mode according to FIG. 1*b*. In this example, in the second operating mode the elevator shaft 102 across the entire vertical length thereof is selected as the second region 120 to which the potential location of specific cars is restricted. In the example shown, a first number of cars 130, in this example six cars, are moved to this second region 120. The potential location of this first number of cars 130 is restricted to this second region 120.

This first number of cars 130 is not available for transportation operations in a remaining first region 121 of the elevator shafts. The elevator shaft 101 in this example represents this remaining first region. The remaining cars 140 carry out regular transportation operations in the remaining first region 121 of the elevator shafts. The two remaining cars 140 in the elevator shaft 101 in this second operating mode are moved bidirectionally, that is to say upward as well as downward.

The first number of cars 130 is in particular stored or parked, respectively, in the second region 120. The first number of cars 130 herein do not carry out any transportation operations. For example individual or all cars of the first number of cars 130 can be serviced in the second region 120. In the course thereof for example, maintenance, service, and/or repair works can be carried out on the respective cars. It can be checked for example whether the respective cars produce the required performance figures and meet predefined safety guidelines.

A further preferred embodiment of an elevator system according to the invention is schematically illustrated and identified by 200 in FIG. 2. The elevator system 200 has three elevator shafts 201, 202, 203. Connections 205 and 206, respectively, are provided between the elevator shafts 201, 202, 203 in each case on an uppermost floor and on a lowermost floor.

Figure 2B:
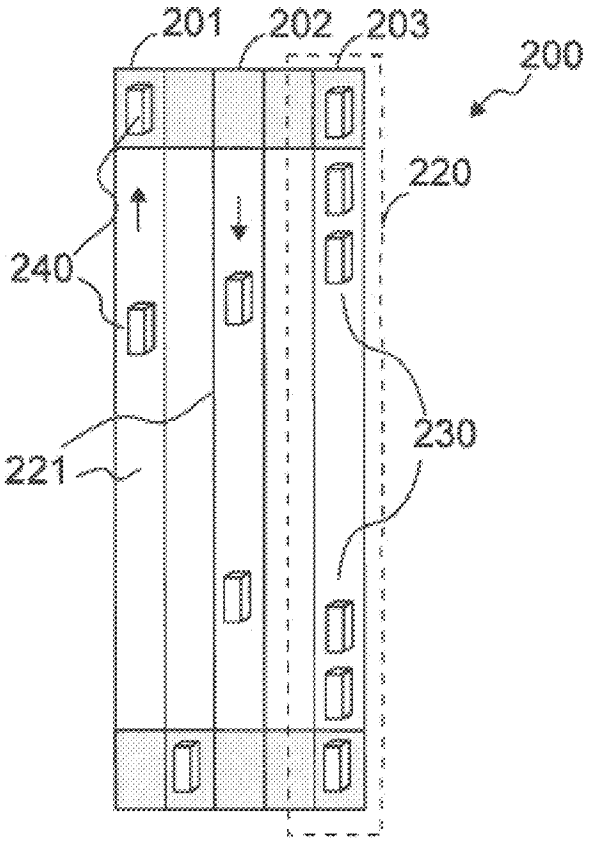
FIG. 2*b* is a schematic view of the example elevator system of FIG. 2*a* operating in a second operating mode.
Figure 2A:
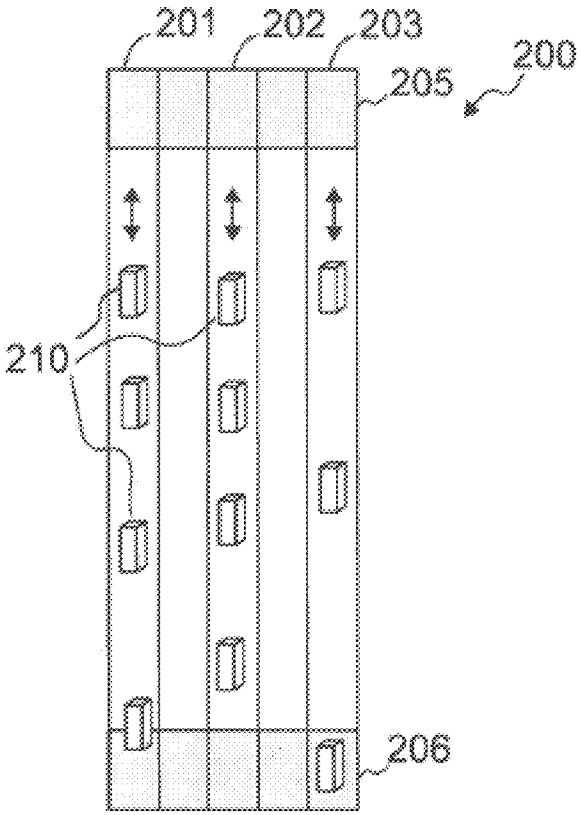
FIG. 2*a* is a schematic view of another example elevator system operating in a first operating mode.

According to FIG. 2*a*, in the first operating mode a number of cars 210, in this example eleven cars, are moved in the elevator shafts 201, 202, 203. The cars 210 can switch between the elevator shafts 201, 202, 203. In this example, cars in all three elevator shafts 201, 202, 203 are in each case moved bidirectionally, that is to say upward as well as downward.

In the second operating mode according to FIG. 2*b*, the elevator shaft 203 across the entire vertical length thereof is selected as the second region 220 to which the potential location of specific cars is restricted and in which cars can be stored, for example. In the present example, a first number of cars 230, in this example six cars, are stored in this second region 220. This first number of cars 230 are not available for transportation operations in a remaining first region 221 of the elevator shafts. The elevator shafts 201 and 202 represent this remaining first region 221. The remaining cars 240 carry out regular transportation operations in the remaining first region 221 of the elevator shafts. The remaining cars 240 are moved only upward in the elevator shaft 201 and only downward in the elevator shaft 202, for example.

A further preferred embodiment of an elevator system according to the invention is schematically illustrated and identified by 300 in FIG. 3. The elevator system 300 has four elevator shafts 301, 302, 303, and 304. Three connection paths 305, 306, and 307 are provided between the elevator shafts 301, 302, 303, and 304. The connection path 305 is provided on an uppermost floor, for example on the tenth floor, and the connection path 307 is provided on the lowermost floor, for example the ground floor. The connection path 306 is provided on the fifth floor, for example.

Figure 3C:
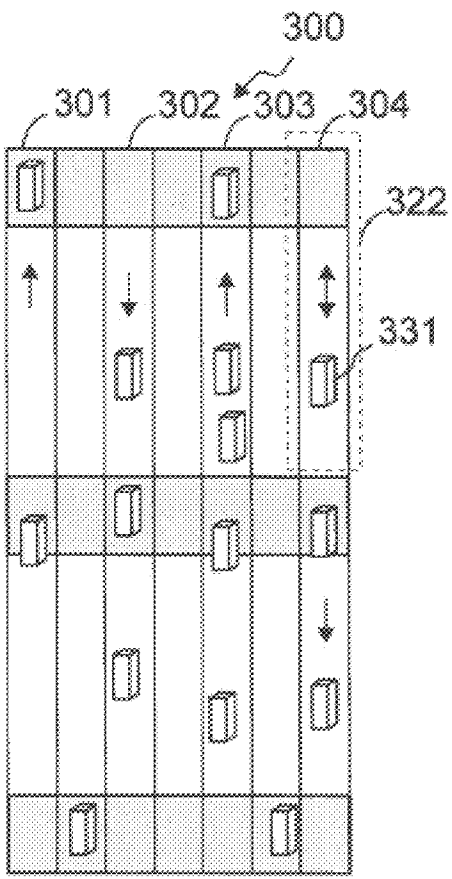
FIG. 3*c* is a schematic view of the example elevator system of FIG. 3*a* operating in a second operating mode, wherein some cars are restricted to a certain region of the elevator system.
Figure 3B:
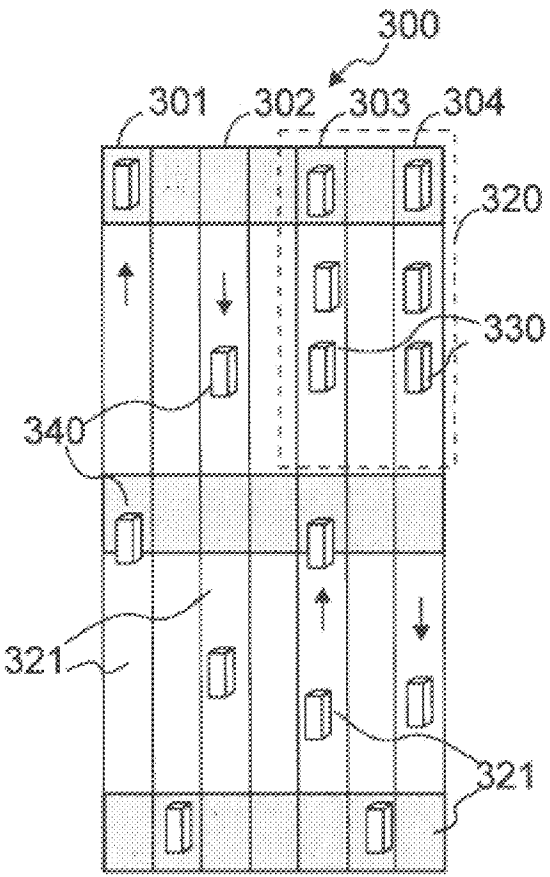
FIG. 3*b* is a schematic view of the example elevator system of FIG. 3*a* operating in a second operating mode.
Figure 3A:
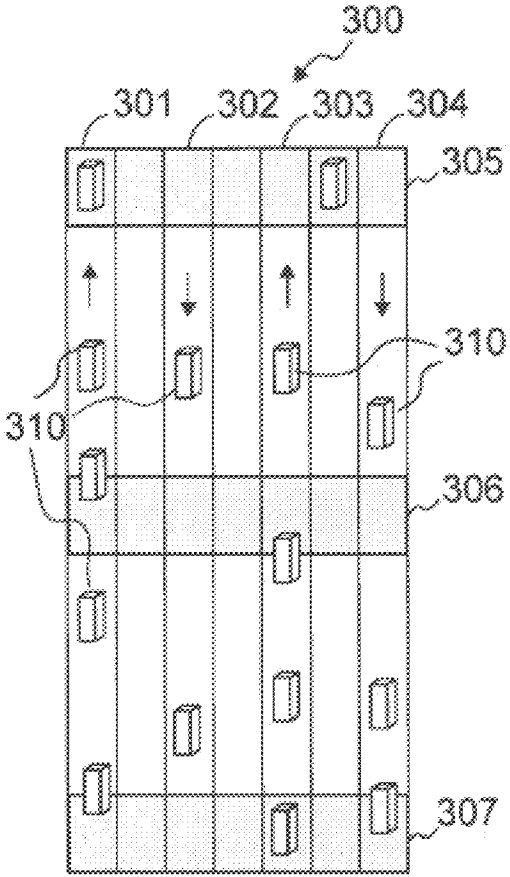
FIG. 3*a* is a schematic view of still another example elevator system operating in a first operating mode.

In the first operating mode according to FIG. 3*a*, a number of cars 310, in this example fifteen cars, are moved in the elevator shafts 301, 302, 303, and 304. In particular, all of the cars 310 can switch between all four elevator shafts 301, 302, 303, and 304. The elevator shafts 301, 302, 303, and 304 are each used unidirectionally. Cars are only moved upward in the elevator shafts 301 and 303, and only downward in the elevator shafts 302 and 304.

In the second operating mode according to FIG. 3*b*, only a part of the elevator shafts 303 and 304 is in each case selected as the second region 320 for storing cars. For example, the part between the sixth and the tenth floor is in each case selected as the second region 320. The part between the ground floor and the sixth floor of the elevator shafts 303 and 304, and the elevator shafts 301 and 302 represent the remaining first region 321 of the elevator shafts.

A first number of cars 330, in this example six cars, are stored in the second region 320, that is to say that the potential location of the cars 330 is restricted to the second region 320. This first number of cars 330 are not available for transportation operations in the remaining first region 321 of the elevator shafts. The remaining cars 340 carry out regular transportation operations in the remaining region 221 of the elevator shafts. The remaining cars 340 in the elevator shafts 301 and 302 and in the remaining parts of the elevator shafts 303 and 304 are in each case moved unidirectionally.

As an alternative to storing or parking, respectively, individual cars in the selected second region, individual cars of which the potential location has been restricted to a second region can also be used for local transportation operations within this second region, as is illustrated with reference to FIG. 3*c*.

In FIG. 3*c* the elevator system 300 in a manner analogous to that of FIG. 3*b* is schematically illustrated in the second operating mode. In this example, a part of the elevator shaft 304 is selected as the second region 322 to which the potential location of specific cars is restricted. For example, the part between the sixth and the tenth floor is selected as the second region 322 to which the potential location of a car 331 is restricted. The part between the ground floor and the sixth floor of the elevator shaft 304, and the elevator shafts 301, 302, and 303 represent the remaining first region of the elevator shafts. The remaining cars 340 carry out regular transportation operations in the remaining first region of the elevator shafts. The remaining cars 340 in the elevator shafts 301, 302, 303, and in the remaining part of the elevator shaft 304 are in each case displaced unidirectionally, for example.

The car 331 is used for transportation operations within the second region 322. The car 331 in the course of these transportation operations does not leave the second region 322. The car 331 in the second region 322 is displaced bidirectionally, for example.

Of course, in a manner analogous to that of car 331, a plurality of cars can also be used for transportation operations within the second region 322. Like the size of the second region 322, the number of cars which are used for transportation operations within the second region 322 can be varied on demand during the second operating mode, for example so as to depend on operating parameters of the elevator system.

A further preferred embodiment of an elevator system according to the invention is schematically illustrated and identified by 400 in FIG. 4. The elevator system 400 has four elevator shafts 401, 402, 403, and 404. Two connections 405 and 406 are provided between the elevator shafts 401, 402, 403, 404.

Figure 4B:
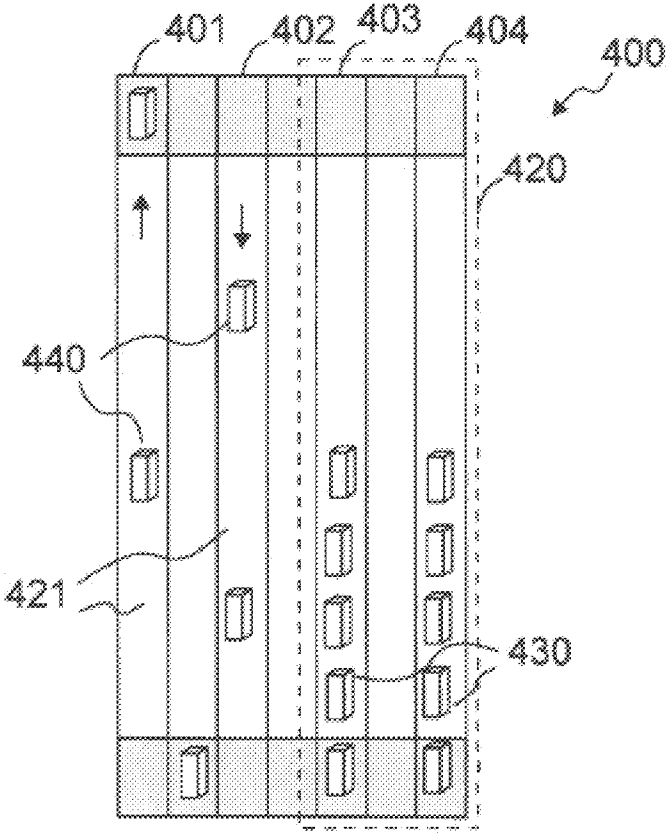
FIG. 4*b* is a schematic view of the example elevator system of FIG. 4*a* operating in a second operating mode.
Figure 4A:
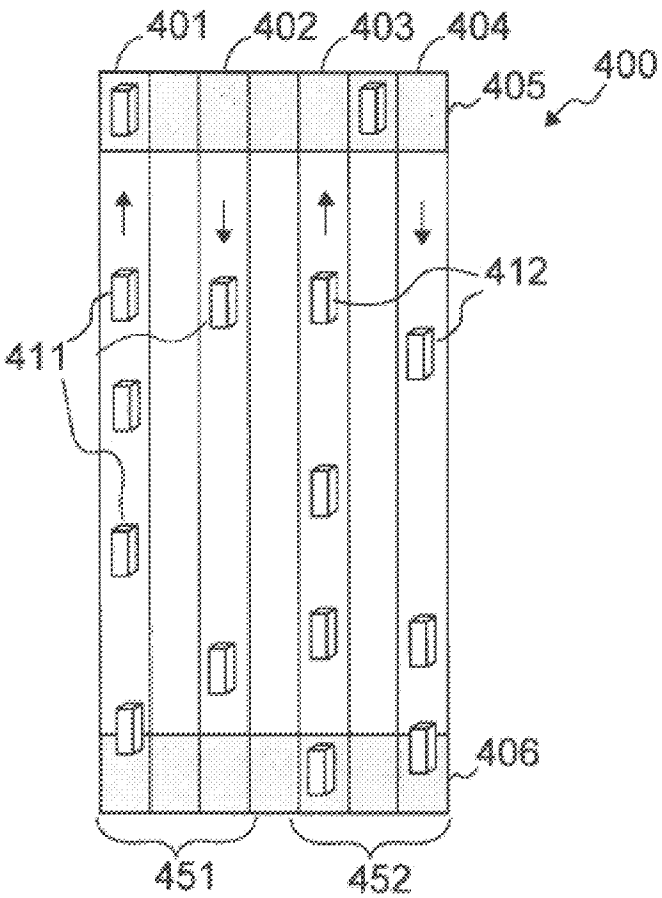
FIG. 4*a* is a schematic view of an example elevator system operating in a first operating mode.

In the first operating mode according to FIG. 4*a*, the elevator shafts 401 and 402 form a first number of elevator shafts, the elevator shafts 403 and 404 forming a second number of elevator shafts. A first number of cars 411, in this example seven cars, are moved in the first number of elevator shafts and are operated therein as a first shaft-switching multiple-car system 451. A second number of cars 412, in this example eight cars, are moved in the second number of elevator shafts and are operated therein as a second shaft-switching multiple-car system 452. The respective cars in the elevator shafts 401 and 403 are moved only upward, and only downward in the elevator shafts 402 and 404.

The elevator system 400 is schematically illustrated in the second operating mode in FIG. 4*b*. A second shaft-switching multiple-car system is no longer operated in the second number of elevator shafts herein. The elevator shafts 403 and 404 are selected as the second region 420 to which the potential location of specific cars is restricted, or in which cars can be stored, for example. The elevator shafts 401 and 402 represent the remaining first regions 421 of the elevator shafts. Ten cars 430 are stored in the second region 420 and are not available for transportation operations in the remaining first region 421 of the elevator shafts. The five remaining cars 440 in the elevator shafts 401 are moved only upward and in the elevator shaft 402 only downward.

The elevator systems 200, 300, and 400 according to FIGS. 2, 3, and 4 are operated in the first or the second operating mode in particular so as to depend in each case on operating parameters, in a manner analogous to that of the elevator system 100 according to FIG. 1. In particular, utilization profiles of the respective elevator systems 200, 300, or 400, respectively, are used in each case as operating parameters of this kind.

Alternatively, the cars 130, 230, or 430, respectively, which according to FIG. 1*b*, 2*b*, or 4*b*, respectively, are stored in the respective second region 120, 220, or 420, can also be used for transportation operations within the respective second region 120, 220, or 420, respectively, in a manner analogous to that of the cars 331 of the elevator system 300 and analogous to that of FIG. 3*c*.

LIST OF REFERENCE SIGNS

100 Elevator system
101 Elevator shaft
102 Elevator shaft
105 Connection path between elevator shafts
106 Connection path between elevator shafts
110 Cars
120 Restricted region
121 Remaining region
130 Car
200 Elevator system
201 Elevator shaft
202 Elevator shaft
203 Elevator shaft
205 Connection path between elevator shafts
206 Connection path between elevator shafts
210 Cars
220 Restricted second region
221 Remaining first region
230 Car
300 Elevator system
301 Elevator shaft
302 Elevator shaft
303 Elevator shaft
304 Elevator shaft
305 Connection path between elevator shafts
306 Connection path between elevator shafts
307 Connection path between elevator shafts
310 Cars
320 Restricted second region
321 Remaining first region
322 Restricted second region
323 Remaining first region
330 Car
331 Car
400 Elevator system
401 Elevator shaft
402 Elevator shaft
403 Elevator shaft
404 Elevator shaft
405 Connection path between elevator shafts
406 Connection path between elevator shafts
411 Cars
412 Cars
420 Restricted second region
421 Remaining first region
430 Car

What is claimed is:

1. A method for operating an elevator system with at least two cars and at least two elevator shafts that extend vertically, wherein the at least two cars are movable between the at least two elevator shafts, the method comprising operating the elevator system in a first operating mode or a second operating mode, performing transportation operations in the first operating mode by the at least two cars in the at least two elevator shafts;

restricting at least one of the at least two cars to a second region of the at least two elevator shafts in the second operating mode, wherein the at least one of the at least two cars is not available for transportation operations in a first region of the at least two elevator shafts, wherein the first and second regions do not overlap;

wherein transportation operations involving movement of the at least two cars between the first and second regions are performed in the first operating mode, and further comprising carrying out maintenance, in the second region, on the at least one of the at least two cars that is restricted to the second region in the second operating mode.

2. The method of claim 1 further comprising:

enabling passengers to enter the at least two cars through shaft doors in the first operating mode; and prohibiting passengers from entering the at least two cars through the shaft doors in the second region in the second operating mode.

3. The method of claim 1 wherein in the second operating mode no transportation operations are performed in the second region, wherein in the second operating mode the at least one of the at least two cars that is restricted to the second region is not available for transportation operations.

4. The method of claim 1 wherein in the second operating mode transportation operations are performed by the at least one of the at least two cars that is restricted to the second region.

5. The method of claim 1 further comprising adjusting, in the second operating mode, the number of the at least two cars unavailable for transportation operations based on operating parameters of the elevator system.

6. The method of claim 1 further comprising switching between the first and second operating modes based on operating parameters of the elevator system.

7. The method of claim 1 wherein the second region extends across a plurality of floors of a building.

8. The method of claim 1 wherein the second region extends across an entire vertical length of one of the at least two elevator shafts.

* * * * *